United States Patent [19]

Daly et al.

[11] Patent Number: 4,915,650

[45] Date of Patent: Apr. 10, 1990

[54] ELECTRICAL TERMINALS AND METHOD FOR TERMINATING FLAT POWER CABLE

[75] Inventors: John K. Daly, Scottsdale, Ariz.; William B. Fritz, Hummelstown, Pa.; Earl R. Kreinberg, Phoenix, Ariz.

[73] Assignee: AMP Incorporated, Harrisburg, Pa.

[21] Appl. No.: 338,079

[22] Filed: Apr. 14, 1989

Related U.S. Application Data

[63] Continuation-in-part of Ser. No. 193,852, May 13, 1988, Pat. No. 4,859,204, Ser. No. 194,063, May 13, 1988, Pat. No. 4,859,205, and Ser. No. 298,259, Jan. 13, 1989, Pat. No. 4,867,700, which is a continuation of Ser. No. 193,458, May 13, 1988, abandoned, which is a continuation-in-part of Ser. No. 50,793, May 14, 1987, abandoned.

[51] Int. Cl.[4] ..... H01R 9/07

[52] U.S. Cl. ..... 439/498; 439/422

[58] Field of Search ..... 29/861, 857, 628, 863, 29/865, 866; 439/421-427, 492-499

[56] References Cited

U.S. PATENT DOCUMENTS

| | | | |
|---|---|---|---|
| 2,759,161 | 8/1956 | Berg | 339/97 |
| 3,201,744 | 8/1965 | Dean | 339/97 |
| 3,247,316 | 4/1966 | Weimer, Jr. | 174/94 |
| 3,259,873 | 7/1966 | Parkinson et al. | 339/97 |
| 3,541,227 | 11/1970 | Bendrick | 174/94 |
| 3,599,173 | 8/1971 | Bridle | 339/99 |
| 3,668,613 | 6/1972 | Klosin | 339/97 C |
| 3,706,121 | 12/1972 | Gillespie | 29/203 H |
| 3,728,473 | 4/1973 | Kuo | 174/84 C |
| 3,754,204 | 8/1973 | Raitport et al. | 339/32 R |
| 3,825,881 | 7/1974 | Wigby | 339/97 R |
| 3,851,294 | 11/1974 | Palazzetti et al. | 339/17 F |
| 3,854,787 | 12/1974 | Snyder, Jr. | 339/103 R |
| 3,881,796 | 5/1975 | Saunders | 339/97 C |
| 4,012,101 | 3/1977 | Damoisiaux et al. | 339/97 C |
| 4,059,897 | 11/1977 | Marquis | 29/432.1 |
| 4,082,402 | 4/1978 | Kinkaid et al. | 339/97 C |
| 4,106,836 | 8/1978 | Asick et al. | 339/97 C |
| 4,241,498 | 12/1980 | Brandeau | 29/861 |
| 4,248,493 | 2/1981 | Kuo | 339/97 R |
| 4,285,561 | 8/1981 | Chow | 339/14 R |
| 4,326,764 | 4/1982 | Asick et al. | 339/14 R |
| 4,352,531 | 10/1982 | Gutter | 339/14 R |
| 4,371,225 | 2/1983 | Narozny | 339/97 C |
| 4,451,099 | 5/1984 | Bricker, Jr. et al. | 339/14 R |
| 4,457,576 | 7/1984 | Cosmos et al. | 339/143 R |
| 4,602,831 | 7/1986 | Lockard | 339/14 R |
| 4,655,515 | 4/1987 | Hamsher, Jr. et al. | 339/14 R |
| 4,669,798 | 6/1987 | Daum et al. | 439/423 |
| 4,769,896 | 9/1988 | Denlinger et al. | 29/509 |
| 4,772,212 | 9/1988 | Sotolongo | 439/98 |
| 4,773,878 | 9/1988 | Hansell, III | 439/497 |

FOREIGN PATENT DOCUMENTS

| | | |
|---|---|---|
| 0285344 | 10/1988 | European Pat. Off. . |
| 1957183 | 6/1970 | Fed. Rep. of Germany . |
| 7239900 | 3/1973 | Fed. Rep. of Germany . |
| 2228780 | 1/1974 | Fed. Rep. of Germany . |

OTHER PUBLICATIONS

AMP Data Sheet 74-279 Issued 7-84, "AMP Termi--Foil Terminals and Splices", AMP Incorporated, Harrisburg, PA.

*Primary Examiner*—David Pirlot

*Attorney, Agent, or Firm*—Anton P. Ness

[57] ABSTRACT

A pair of transition adapter terminals especially useful for terminating respective conductors of a dual conductor flat power cable, include respective contact sections at forward ends thereof. Cable-receiving slots across rearward ends thereof extend between pairs of integral bight straps or hinge sections joining upper and lower terminal plate sections. The slots receive respective tab-shaped portions of flat power cable insertably thereinto which are then disposed between the opposed slightly spaced upper and lower plate sections. The plate sections include opposing arrays of shearing waves shapes alternating with relief recesses transversely across, with each wave shape opposed from a respective relief recess. When the plate sections are pressed together, the opposing arrays of wave shapes shear the insulation and the conductor of the tab-shaped cable portion therebetween and simultaneously extrude the sheared conductor strips into the opposed relief recesses, exposing sheared conductor edges for enabling electrical connections therewith. The cable is prepared by cutting an axial slot along the centerline preferably dimensioned so that the exposed inwardly facing conductor edges are bitten into by the adjacent bight straps upon pressing together the plate sections.

20 Claims, 8 Drawing Sheets

ELECTRICAL TERMINALS AND METHOD FOR TERMINATING FLAT POWER CABLE

REFERENCE TO RELATED APPLICATIONS

The present application is a continuation-in-part application of U.S. patent application Ser. Nos. 07/193,852, U.S. Pat. No. 4,859,204 and 07/194,063, U.S. Pat. No. 4,859,205 both filed May 13, 1988 and of Ser. No. 07/298,259, U.S. Pat. No. 4,867,700 filed Jan. 13, 1989 which is a continuation application of Ser. No. 07/193,458 filed May 13, 1988 now abandoned which was a continuation-in-part of Ser. No. 07/050,793 filed May 14, 1987, now abandoned.

FIELD OF THE INVENTION

The present invention relates to the field of electrical connectors and more particularly to terminating flat power cables.

BACKGROUND OF THE INVENTION

U.S. patent application Ser. Nos. 07/298,259, 07/193,852 and 07/194,063 disclose a transition adapter which is crimped onto a flat power cable by penetrating the insulation covering the cable's conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. One embodiment of the transition adapter is stamped and formed of sheet metal and in one embodiment includes a pair of opposing plate sections disposed along respective major surfaces of the cable and including opposing termination regions extending transversely across the cable. Each terminating region includes a transverse array of alternating shearing wave shapes and relief recesses of equal width, the relief recesses defined by arcuate projections extending away from the cable-proximate side, and the wave shapes extending outwardly from the cable-proximate side and toward relief recesses in the opposed plate section. Each shearing wave shape has a transverse crest between parallel side edges, and the side edges of the corresponding relief recesses are associated with the wave side edges to comprise pairs of shearing edges, preferably with zero clearance. When the plate sections are pressed against a cable section disposed therebetween the crests of the wave shapes initiate cable shearing by their axially oriented side edges cutting through the cable insulation and into and through the metal conductor. The wave shapes extrude the sheared cable strips outwardly into the opposing relief recesses as the shears propagate axially along the cable for limited distances, forming a series of interlocking wave joints with the cable while exposing newly sheared edges of the cable conductor for electrical connection therewith.

Further with regard to the transition adapter of the above applications, fastened to the outwardly facing surface of the plate sections at the terminating regions are respective inserts of low resistance copper. The inserts have adapter-facing surfaces conforming closely to the shaped outer surface of the terminating region, with alternating wave shapes and apertures disposed outwardly of and along the adapter's shearing wave shapes and relief recesses. Upon termination the wave joints are within the insert apertures, and the sheared edges of the adjacent conductor strips and of the adapter wave shapes which formed the sheared strips are adjacent to side surfaces of the copper insert apertures. A two-step staking process is preferred: in a first step the wave joints are split axially so that portions of each arcuate shape of both adapter plate sections are forced inwardly against the adjacent sheared conductor strip of the respective wave joint to define spring fingers whose ends pin the conductor strip against the opposing wave crest to store energy in the joint; and in the second step a staking process deforms the insert between the sheared strips to deform the copper against the sheared conductor and wave shape edges, forming gas-tight, heat and vibration resistant electrical connections with the cable conductor and with the transition adapter, so that the inserts are electrically in series at a plurality of locations between the conductor and the adapter.

A contact section is integrally included on the transition adapter enabling mating with corresponding contact means of an electrical connector, or a bus bar, or a power supply terminal, for example, and can include a plurality of contact sections to distribute the power to a corresponding plurality of contact means if desired. One such contact section is disclosed in U.S. patent application Ser. No. 07/233,684 filed Aug. 18, 1988 and assigned to the assignee hereof. A housing or other dielectric covering can be placed around the termination as desired, such as is disclosed in U.S. patent application Ser. No. 07/234,063 filed Aug. 18, 1988 and assigned to the assignee hereof.

Also entering commercial acceptance is a dual conductor flat cable, wherein a pair of parallel spaced coplanar flat conductor strips having insulation extruded therearound define power and return paths for electrical power transmission. One method has been devised as disclosed in U.S. Pat. No. 4,241,498 which involves a member associated with one of the two conductors having upper and lower sections joined at a tab. The upper and lower sections are brought along the upper and lower surfaces of the conductor from the side of the cable so that the tab is disposed laterally of the cable. The upper and lower sections have semicylindrical metallic jaws having alternating grooves and lands with the grooves of one jaw adapted to receive thereinto the lands of the opposing jaw when the upper and lower sections are pressed against the conductor. The lands shear strips of the conductor and extrude the sheared strips into the opposing grooves, in a punch and die process. After termination the sheared conductor edges are disposed adjacent sides of the grooves of the semicylindrical jaws to form electrical connections therewith The tab extends laterally from the cable and is exposed for electrical engagement therewith by another electrical article. The other conductor may be similarly terminated at a nearby location.

It is desired to provide terminals and a method for terminating dual conductor flat power cable.

It is also desired to provide a means for securing terminals terminated to single or dual conductor flat power cable against axial movement therealong.

SUMMARY OF THE INVENTION

The present invention comprises a pair of transition adapter terminals to be terminated adjacent each other to an end of flat power cable and then placed in a low profile housing to define an electrical connector. The terminals are initially joined together by a severable link for facilitating handling and assembly to the cable. The pair of terminals may be used with single conductor flat power cable but are especially suitable for terminating dual conductor flat power cable, in which case the pair of terminals are separated from each other by severing the link therebetween after termination after which the terminals are inserted into the housing. The terminals include contact sections then extending forwardly from the cable end for electrical connection with corresponding contact means of another electrical article such as another cable connector, a header mounted on a printed circuit board, terminal posts of a power supply, or a bus bar.

Each terminal has a pair of opposed plate sections transversely across each of which are an array of shearing wave shapes alternating with relief recesses, so that when the pair of plate sections disposed against major surfaces of the flat cable at an end thereof are pressed together and against the cable therebetween, the arrays of shearing wave shapes cooperate to shear the conductor of the flat cable into a plurality of strips which remain integral with the cable. The wave shapes also extrude the newly sheared conductor strips into the opposing relief recesses so that newly sheared conductor edges are moved adjacent electrical engagement surfaces defined by the vertical side edges of the adjacent shearing wave shapes forming electrical connections of the adapter terminals with the flat cable conductors.

The pair of plate sections of each terminal both extend forwardly from a rearward cable-receiving terminal end where they coextend forwardly at a slight angle from a pair of bight sections spaced laterally apart defining a cable-receiving slot therebetween of known transverse width. Such a cable-receiving slot is generally disclosed in Ser. No. 07/194,063. Tab-shaped portions are formed on the end section of the cable and are inserted through the cable-receiving slots of the terminals and are disposed between upper and lower plate sections of each terminal. The upper and lower plate sections of each pair are pressed respectively together by being rotated about the bight sections which act as integral hinges, so that the shearing wave shapes shear and extrude strips of the conductor (or conductors) of the cable forming a termination of the terminals to the cable.

The tab-shaped cable portions are prepared by cutting an axial slot precisely along the cable centerline, thereby exposing sheared conductor edges axially along both sides of the slot whether the cable is single or dual conductor. The axial cable slot is cut to have a width precisely selected to correspond with the cable-receiving slots of the terminals, so that the two tab-shaped cable portions fit through the terminal slots with no more than a slight clearance with the inside edges of the pair of bight sections of each terminal. More importantly, the exposed axial conductor edges are formed precisely to be adjacent outwardly facing edges of the inner ones of the bight sections of the respective terminals. When the terminal plate sections are pressed together terminating the cable, the inner bight section already at least adjacent the conductor edge along the cable slot is deformed slightly against the conductor edge thereby biting into the metal, while the outer bight section is deformed slightly against and into the insulative coating along the adjacent lateral outer edge of the cable, thus gripping the tab-shaped cable portions after termination to act as stop mechanisms against axial movement of the terminals with respect to the cable and relieving stress on the terminations.

The terminals terminated to the tab-shaped cable portions are insertable into respective openings at the rearward end of n integral housing until the contact sections are disposed appropriately along the mating face of the housing at least exposed to be mated with corresponding contact means of an electrical article. A cable strain relief member is assembled to the rearward end of the housing to define a cable exit. As is disclosed in U.S. patent application Ser. No. 07/338,790; filed Apr. 14, 1989 and assigned to the assignee hereof, the cable strain relief member may be molded of plastic and be bifurcated to have upper and lower transverse struts joined at one lateral end, to be inserted over the flat cable from one side thereof after termination by the terminals. The member has forwardly extending latch arms which latchingly engage the housing when moved forwardly along the cable and against the rearward end of the housing. One of the latch arms is an integral member at the integrally joined lateral end while the other is split horizontally comprising upper and lower arm sections respectively extending forwardly from the upper and lower struts. When latched the strain relief member closely fits around and clamps against the flat cable disposed between the upper and lower struts.

The strain relief member also includes rearward stop surfaces to maintain the terminals properly positioned axially within the housing, maintaining the contact sections in position axially to enhance wear resistance of the contact surfaces by minimizing axial movement thereof. The housing can thus be molded as an integral member to precisely define upper and lower terminal-proximate ledges of fixed spacing to maintain the terminals closely positioned vertically within the respective cavities of the housing to assist in minimizing detrimental effects of vibration on the terminations.

It is an objective of the present invention to provide a method for terminating dual conductor flat power cable.

It is also an objective to provide a method for terminating a pair of terminals onto an end of flat power cable having either a single conductor or two conductors.

An embodiment of the pair of transition adapter terminals will now be specifically described with reference to the accompanying drawings.

DETAILED DESCRIPTION OF THE PREFERRED EMBODIMENTS

Figure 1:
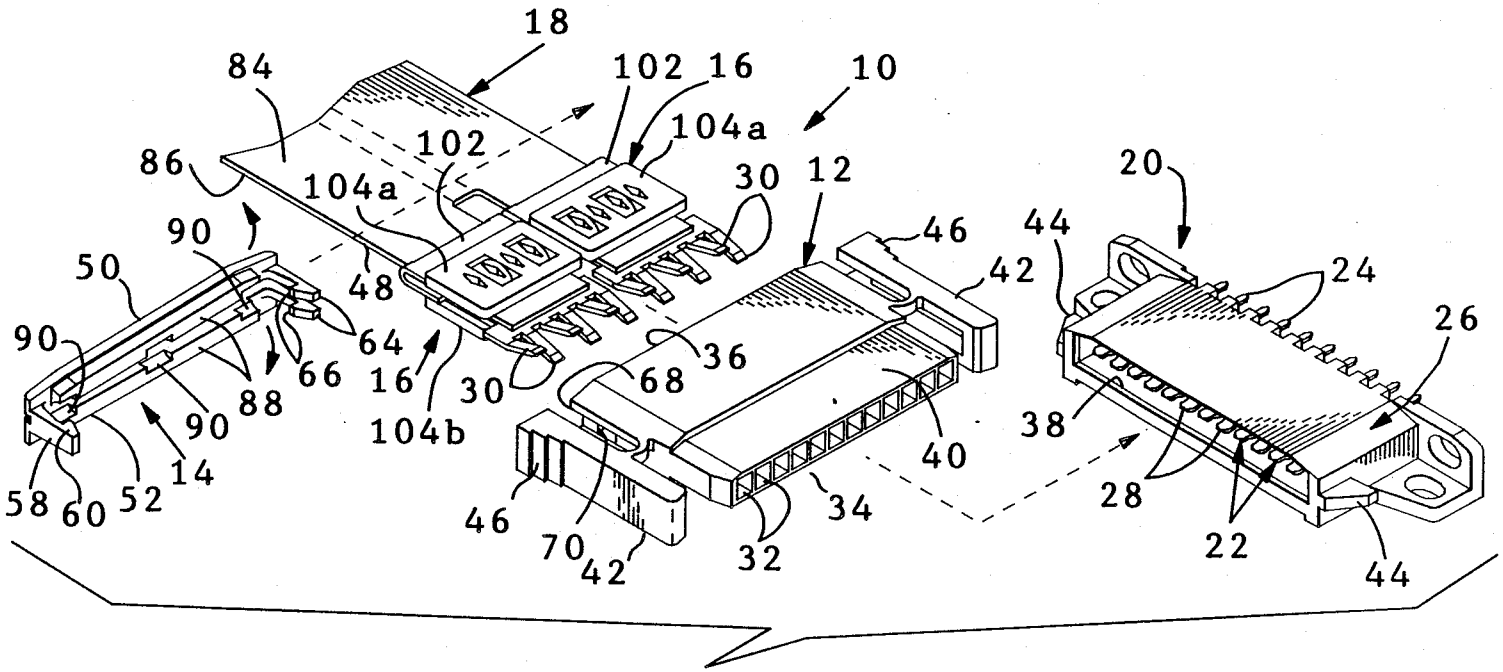
FIG. 1 is a perspective view of the connector of the present invention, and a connector matable therewith, with the terminated flat cable exploded from the housing and a strain relief member exploded from the connector.

Connector 10 of FIG. 1 includes a housing member 12 and rearward cable exit or strain relief member 14, adapted to house a pair of terminals 16 terminated onto flat power cable 18. Connector 20 is matable with connector 10 and is adapted to house a corresponding pair of terminals 22 which are shown to include post sections 24 extending rearwardly from housing 26 for insertion into corresponding plated through-holes of a printed circuit board (not shown). Terminals 22 also are shown having spring arm contact sections 28 at forward ends thereof matable with splines 30 at forward ends of terminals 16, when connectors 10 and 20 are mated. Housing 12 includes a plurality of forward passageways 32 in communication with mating face 34 within each of which is disposed a spline 30 after terminals 16 are inserted into housing member 12 from rearward end 36. Housing 26 of connector 20 includes a large cavity 38 within which are disposed spring arms 28, and large cavity 38 is adapted to receive thereinto forward section 40 of housing 12 of connector 10 upon mating, with spring arms 28 received within passageways 32 to electrically engage respective splines 30. Housing 12 is shown having a pair of latch arms 42 along sides thereof which ride over and latchingly engage a pair of corresponding latching projections 44 of housing 26 to secure the connectors together. Latch arms 42 are shown having rearward gripping portions 46 deflectable inwardly to facilitate delatching from projections 44 upon connector unmating. Latch arms 42 are shown having rearward gripping portions 46 to facilitate delatching from projections 44 upon connector unmating.

Figure 2:
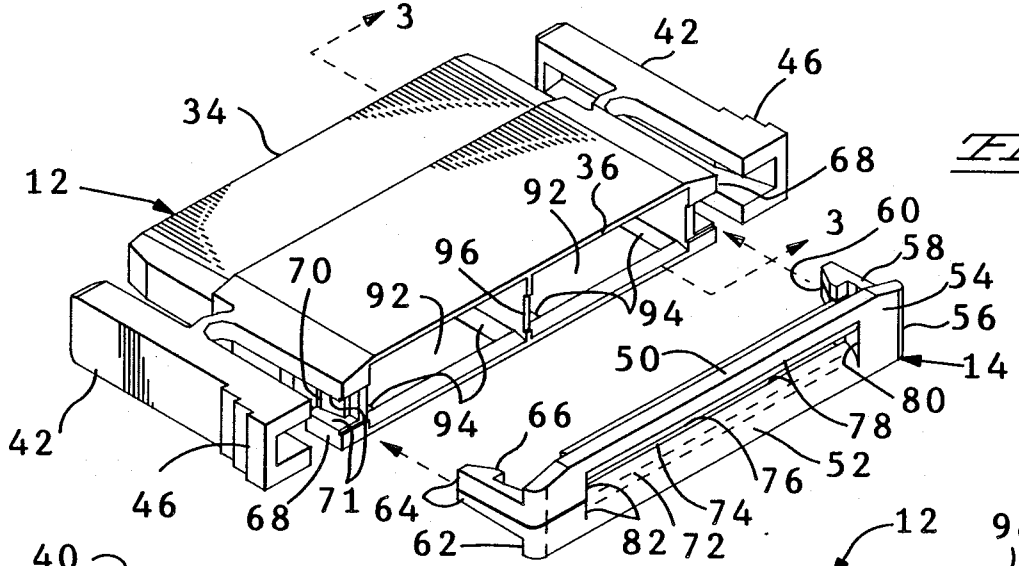
FIG. 2 is a perspective view of the housing and strain relief member of FIG. 1 from rearwardly thereof.

Referring to FIGS. 1 and 2, after terminals 16 on cable 18 are inserted into rearward housing end 36, strain relief member 14 is insertable across flat cable 18 from lateral edge 48 and then movable forwardly therealong to latch securely to housing member 12 along rearward end 36. Strain relief member 14 includes upper and lower struts 50,52 extending laterally from integral section 54 spaced slightly apart for cable 18 eventually to be disposed therebetween. At lateral end 56 including integral section 54, first latch arm 58 extends forwardly to inwardly directed latching projection 60. At lateral end 62 a pair of second latch arms 64 extend forwardly from ends of upper and lower struts 50,52 to inwardly directed latching projections 66 which will cooperate as a single latch arm during latching to connector housing 12. Housing member 12 includes near rearward end 36 and long outer surfaces 68 a pair of latching recesses 70 in channels defined between upper and lower channel wall surfaces 71, for receiving thereinto latching projections 60,66,66 when strain relief member 14 is secured to housing member 12.

Upon assembly to housing member 12 cable strain relief member 14 defines a cable exit or slot 72 between facing surfaces 74,76 of upper and lower struts 50,52 with rounded rearward corners 78 and between side walls 80,82,82 near lateral ends 56,62 respectively. The distance between side walls 80,82,82 is preferably selected to be slightly less than the nominal width of cable 18 to generate a slight interference fit width wise after connector assembly. Further it is preferred that after connector assembly facing surfaces 74,76 of upper and lower struts 50,52 clamp against upper and lower major surfaces 84,86 of cable 18. Forwardly facing surfaces 88 of struts 50,52 shown in FIG. 1 will act as rearward limits or stops engageable by terminals 16 after connector assembly; rounded recesses 90 in surfaces 88 are shown within which rearwardmost portions of terminals 16 are received (FIGS. 13 and 14).

Figure 3:
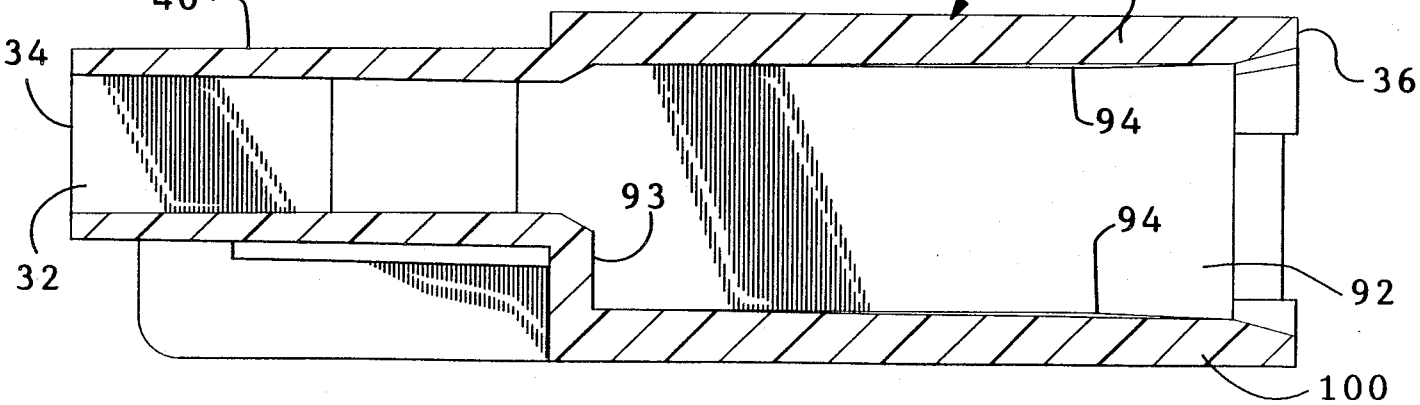
FIG. 3 is a longitudinal section view through the housing taken along lines 3—3 of FIG. 2.
Figure 13:
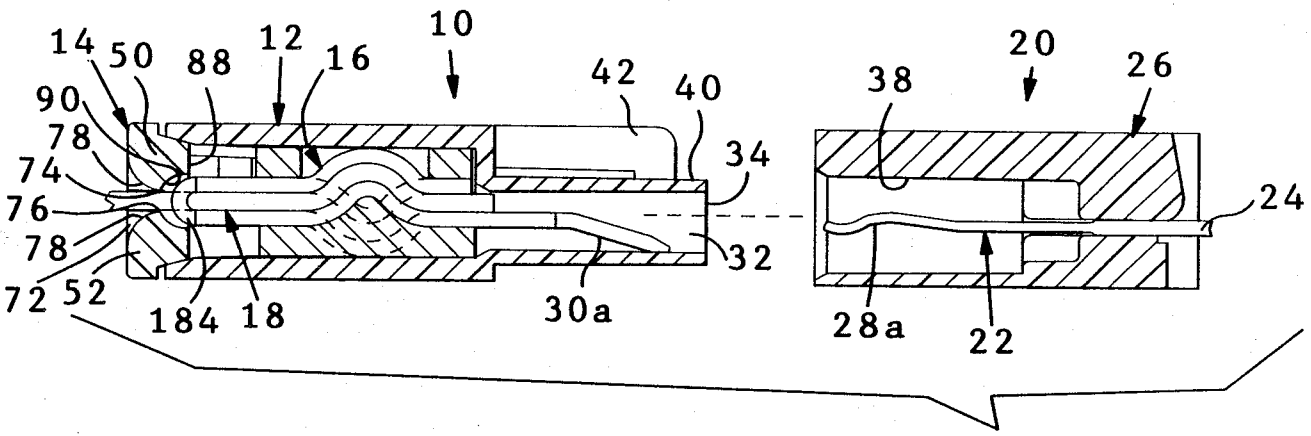
FIGS. 13 and 14 are elevation section views of the connectors of FIGS. 11 and 12 taken along lines 13—13 and 14—14 respectively thereof, unmated and mated.
Figure 14:
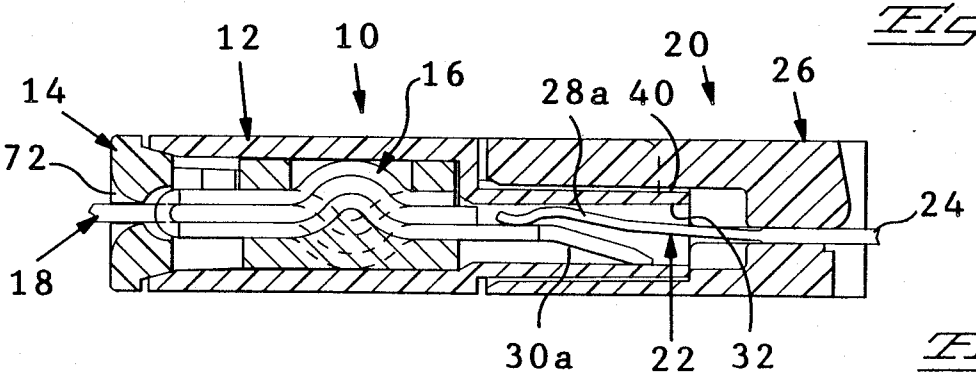

Referring to FIGS. 2 and 3, a pair of large cavities 92 extend forwardly from rearward housing end 36 to rearwardly facing stop surfaces 93, to receive terminals 16 inserted thereinto Pairs of upper and lower ledges 94 are defined axially along both sides of each cavity 92 between which terminals 16 will be disposed, with the distance between the facing ledge surfaces precisely selected so that after connector assembly terminals 16 will be allowed little vertical movement, if any, but allowing for some tolerance in the eventual height of terminals 16 which are terminated to cable 18 (FIGS. 13 and 14). Housing member 12 being integrally molded allows the distance between facing ledge surfaces to be precisely controlled Vertical barrier wall 96 between cavities 92 disallows upper and lower cover sections 98,100 of housing 12 from slight spreading and thus maintains the distance between facing ledge surfaces of he inner pairs thereof.

Figure 4:
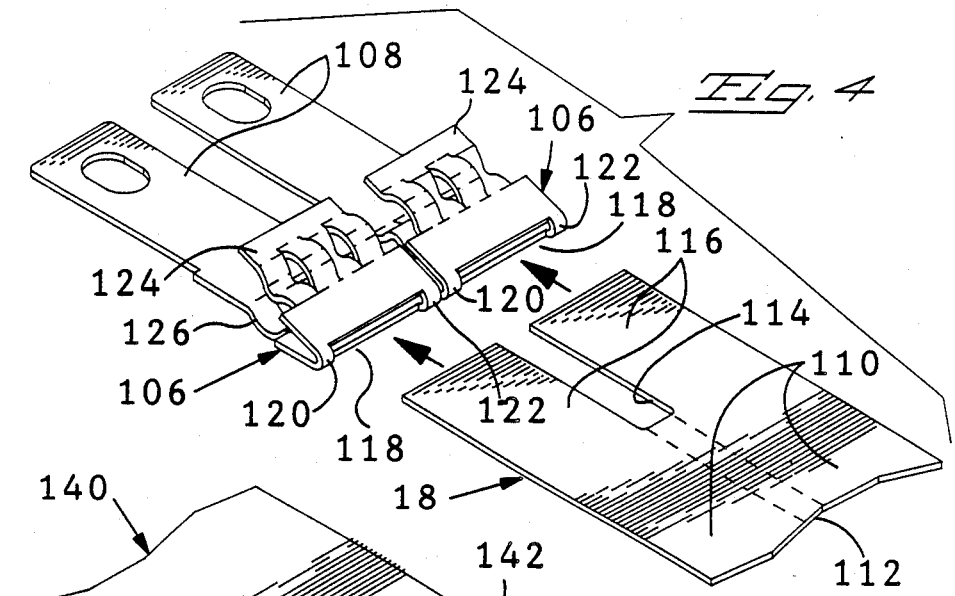
FIG. 4 is a perspective view of the terminals about to receive the prepared cable end for termination thereto, and showing an alternate type of contact section on the terminals.

Terminals 16 include stamped and formed adapter members 102 disposed immediately against cable surfaces 84,86, and also preferably include insert members 104 secured along cable-remote surfaces of adapter members 102 and being of high copper content which establish gas-tight electrical engagement with sheared edges of the cable conductors after termination. FIG. 4 illustrates a pair of adapter members 106 having blade-like contact sections 108 of the type suitable for termination to terminal posts of a power supply; it is preferred that the terminals include insert members but such inserts are not shown in order to assist in illustrating the method of termination. Cable 18 includes two parallel spaced coplanar flat conductor members 110 therein coated by an insulative covering which also defines a medial portion 112 between the conductors 110. As shown cable 18 is prepared by cutting an axial slot 114 rearwardly from the cable end along the cable centerline, slot 114 having a selected width, thereby defining a pair of tab-shaped cable portions 116. Rearward ends 118 of adapter members 106 include a pair of bight sections 120,122 which join upper and lower plate sections 124,126 of adapter members 106.

Figure 5A:
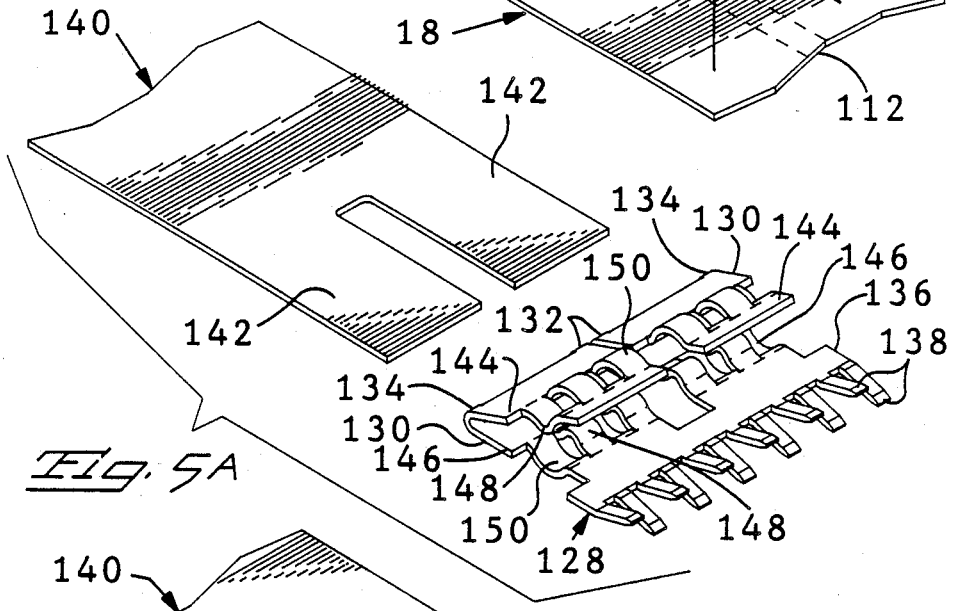
FIGS. 5A and 5B illustrate placing terminals on the cable end prior to termination, with insert members of the terminals not shown, where the flat cable is the single conductor type and the terminals are integral across the contact section.
Figure 5B:
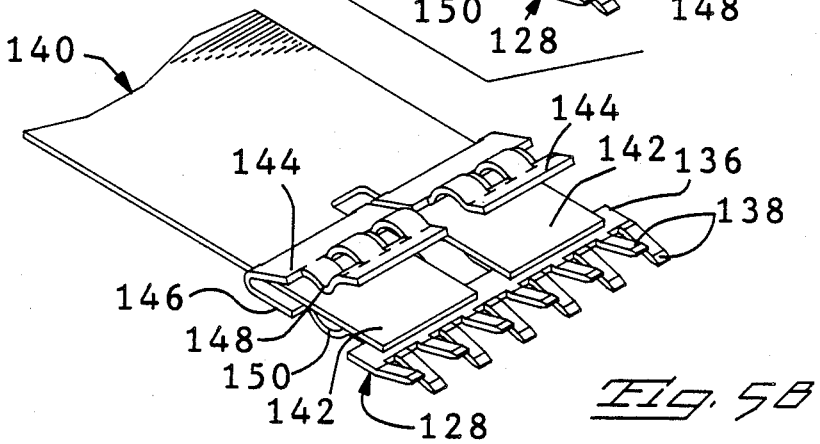

Referring now to FIGS. 5A and 5B, an alternate embodiment of adapter member 128 is shown having two adapter sections 130 each having a cable-receiving slot between pairs of bight sections 132,134. Adapter member 128 is integral across contact section 136 containing splines 138 and is suitable for terminating single conductor cable 140 which has been prepared similarly to cable 18 of FIG. 4 to have a pair of tab-shaped cable portions 142. Tab-shaped cable portions 142 are inserted into and through the cable-receiving slots until cable portions 142 are disposed between pairs of upper and lower plate sections 144,146. Defined transversely across upper and lower plate sections 144,146 are arrays of alternating shearing wave shapes 148 and relief recesses 150, similar to those disclosed in Serial No. 07/298,259, with wave shapes 148 extending toward upper and lower major surfaces of the flat cable.

Figure 6:
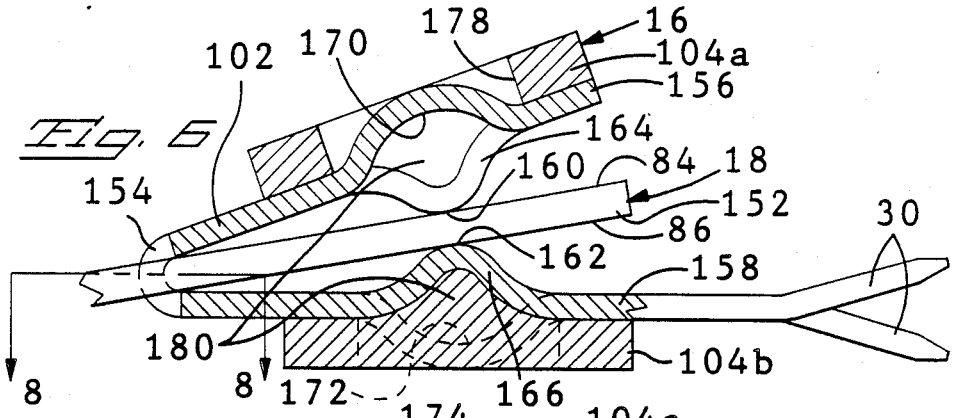
FIGS. 6 and 7 illustrate the terminals of FIG. 1 being terminated to the cable end.
Figure 7:
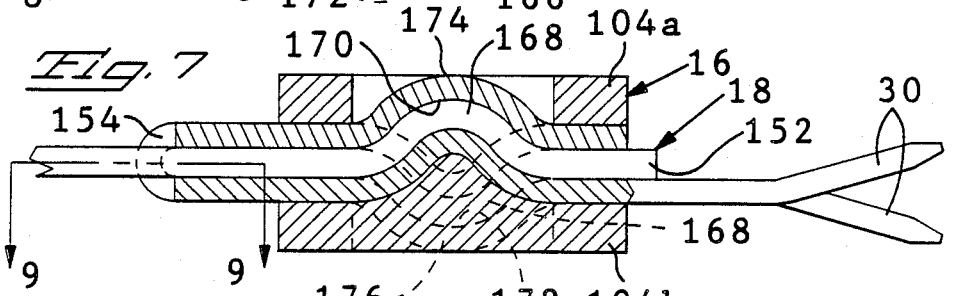

In FIGS. 6 and 7 a representative terminal 16 is shown having an adapter member 102 and upper and lower insert members **104*a*,104*b*, with a tab-shaped cable portion 52 extending through cable-receiving slot 154 and disposed between upper and lower plate sections 156,158 of adapter member 102. Crests 160,162 of shearing wave shapes 164,166 of upper and lower plate sections 156,158 are shown against cable surfaces 84,86 prior to termination in FIG. 6; in FIG. 7, wave shapes 164,166 have sheared the conductor of cable 18 and have extruded the thus-sheared conductor strips 168 into the opposing relief recesses 170,172 to define alternating and interlocking upper and lower wave joints 174,176 disposed in respective apertures 178 of insert members 104. In FIG. 7 sheared conductor edges are disposed adjacent and in electrical engagement with the vertical wall surfaces simultaneously defining the sides of wave shapes 180 and longitudinal side walls of apertures 178 adjacent and alternating with wave shapes 180 transversely across upper and lower insert members 104*a*,104*b*. The wave joints may preferably be split by staking, and the insert members also staked along outwardly facing surfaces of wave shapes 180** to enhance the gas-tight nature of the electrical connections between the insert members and the sheared conductor edges by imparting stored energy in the wave joints.

Figure 8:
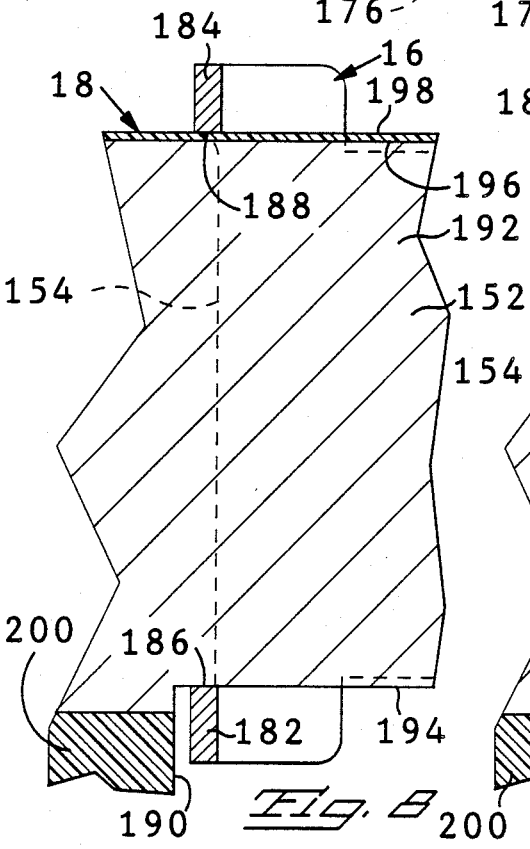
FIGS. 8 and 9 are section views taken along lines 8—8 and 9—9 of FIGS. 6 and 7 respectively, showing the terminals gripping the side edges of the cable end upon termination.
Figure 9:
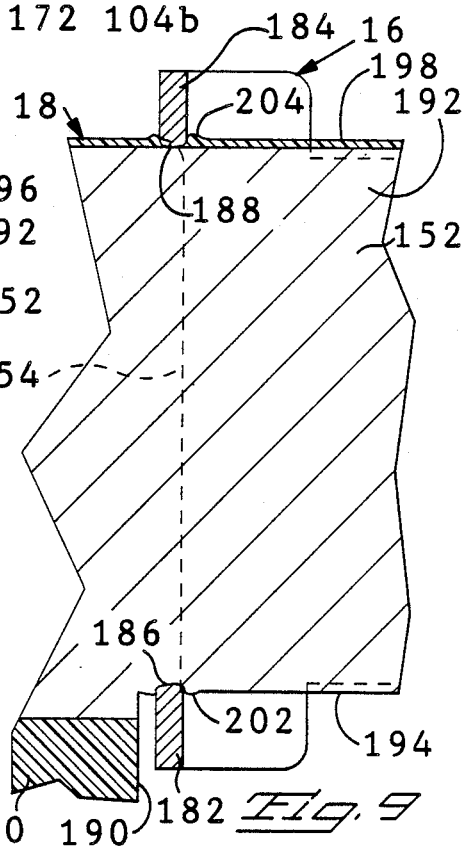

In FIGS. 8 and 9 can be seen the gripping of lateral edges of the tab-shaped conductor portions before and after termination of terminals 16 thereto Inner and outer bight sections 182,184 define cable-receiving slot 154 between facing edges 186,188 thereof. Cable 18 has been prepared as in FIG. 4 by cutting a slot 190 along the cable centerline, thereby shearing conductor 192 forming a sheared edge 194. Cable insulation 196 extends along lateral cable edge 198 and also defines medial strip 200 between the pair of conductors. When upper and lower plate sections of the adapter member are pressed together as in FIG. 7, the metal of the bight sections 182,184 is deformed slightly and protrudes simultaneously against the conductor edge 194 and lateral cable edge 198 thereby biting into the metal of conductor 192 at 202 and compressing the insulation material 196 at 204 to grip the tab-shaped cable portion 152 and comprise an axial stop for terminal 16 along cable 18.

Figure 10:
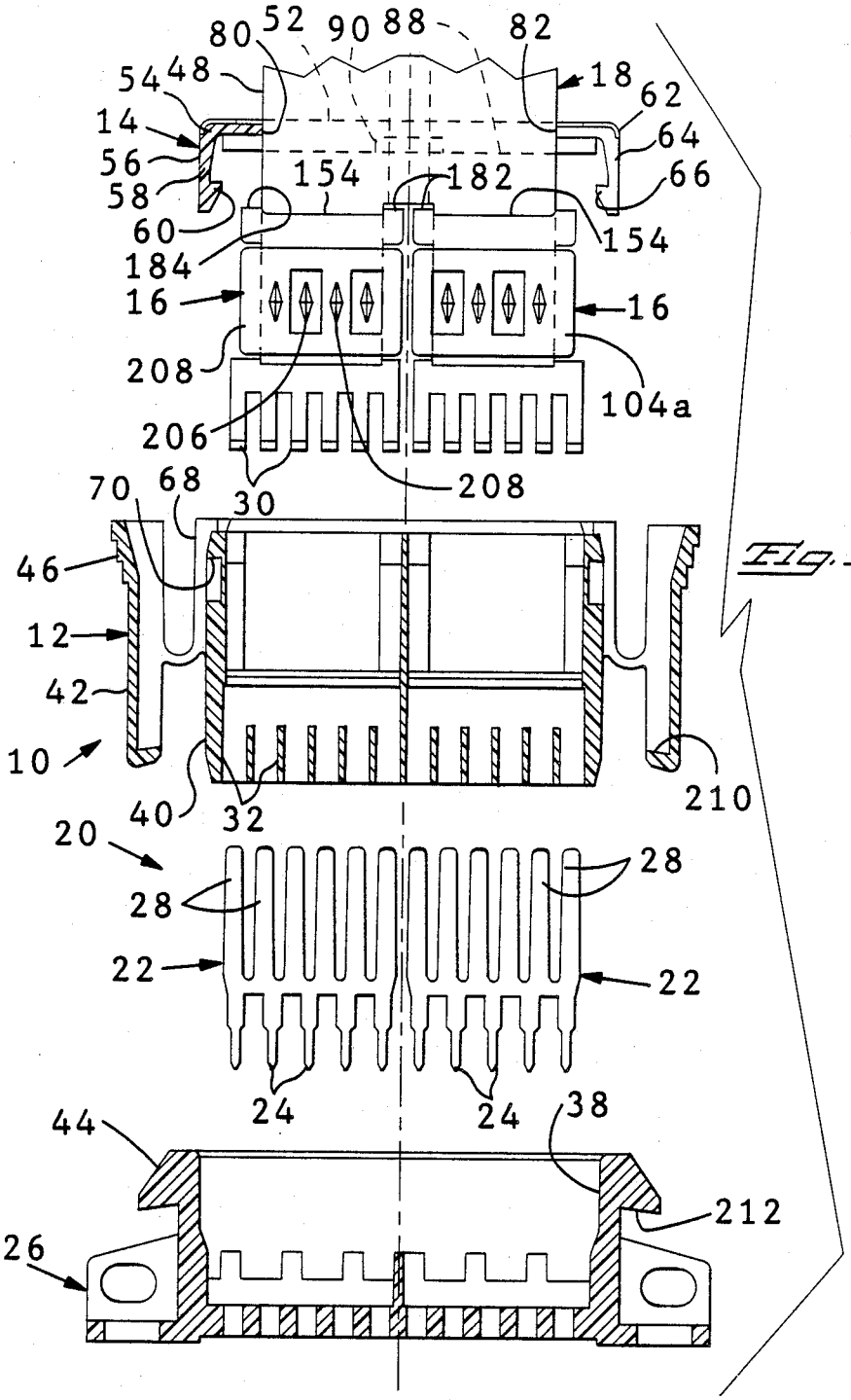
FIGS. 10 through 12 are plan section views of the mating connectors of FIG. 1 prior to securing the respective terminals in the housings, after terminal securing, and after connector mating, respectively.
Figure 11:
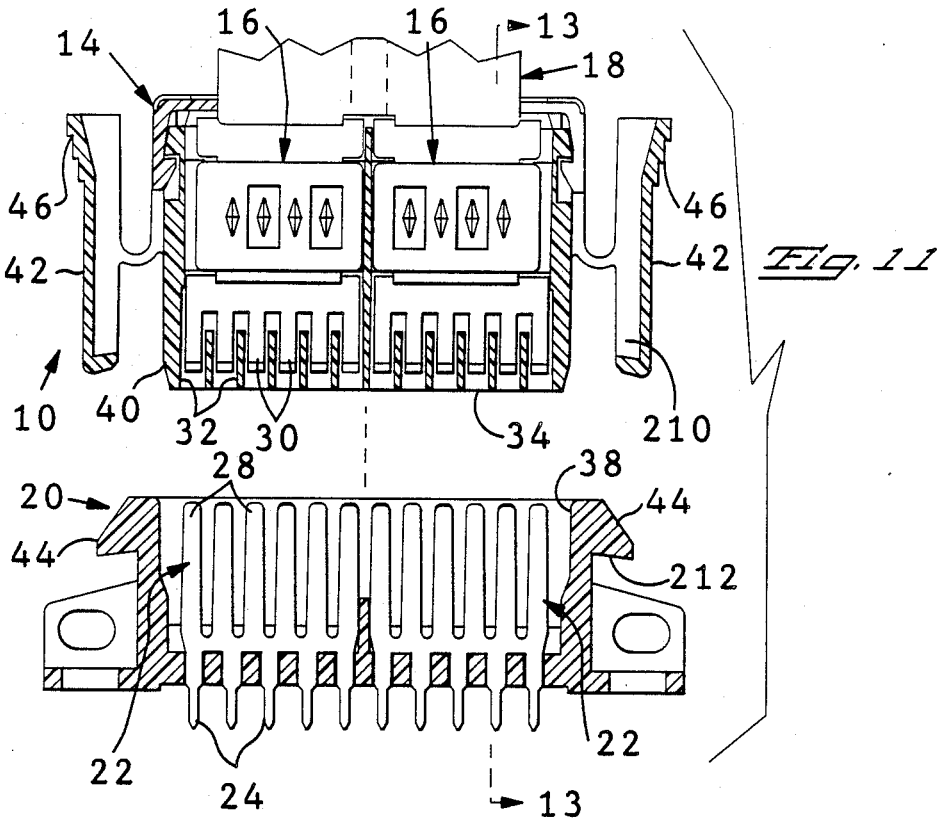
Figure 12:
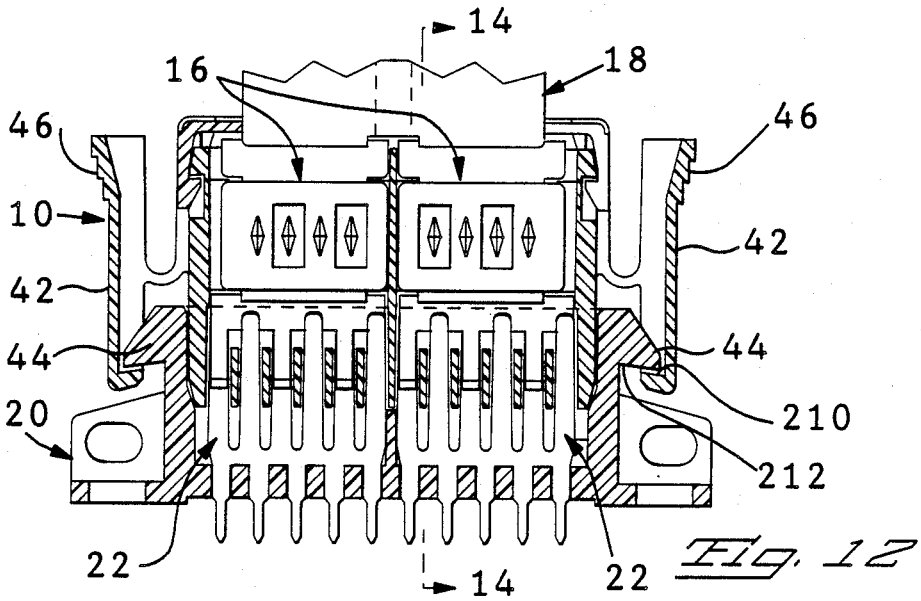

FIGS. 10 to 12 illustrate the assembly of connectors 10 and 20 Terminals 16 have been terminated to tab-shaped cable portions 152 including splitting the wave joints as indicated at 206 and staking the inserts between the wave joints as indicated at 208. Cable strain relief member 14 has been inserted over cable 18 from lateral edge 48 in FIG. 10. In FIG. 11 terminals 16 have been inserted into cavities 92 of housing member 12 with splines 30 within passageways 32, and strain relief member 14 has been latched to housing member 12 by latching projections 66 in latching recesses 70; terminals 22 have been secured in housing member 26 of connector 20 with contact sections 28 arrayed across cavity 38 and post sections 24 extending outwardly from housing member 26. In FIG. 12 connectors 10 and 20 are shown latched and mated together, with latching surfaces 210,212 of latch arms 42 and projections 44 having a slight reverse angle for vibration resistance; forward section 40 of housing member 12 has been received within cavity 38 of housing member 26 and with spring arm contact sections 28 of terminals 22 electrically engaged with splines 30 of terminals 16, alternating upwardly and downwardly across the terminals.

FIGS. 13 and 14 show connectors 10 and 20 being mated, with a downwardly angled spline **30*a* and an upwardly deflectable spring contact arm 28*a* electrically engageable together. Cable strain relief member 14 is shown latched in place defining the cable exit with cable 18 clamped between facing surfaces 74,76 of upper and lower struts 50,52 and a bight section 184 of terminal 16 disposed in a recess 90**.

Figure 15:
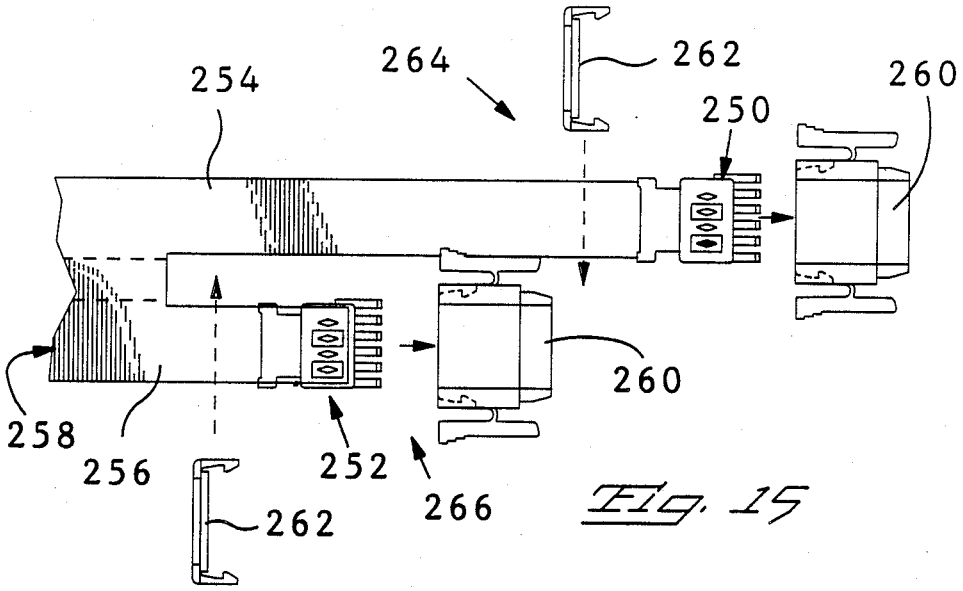
FIGS. 15 and 16 illustrate separate terminals and individual housings and strain relief members for terminating dual conductor flat cable for relative axial spacing of the connectors, before and after insertion of the terminals into the respective housings.
Figure 16:
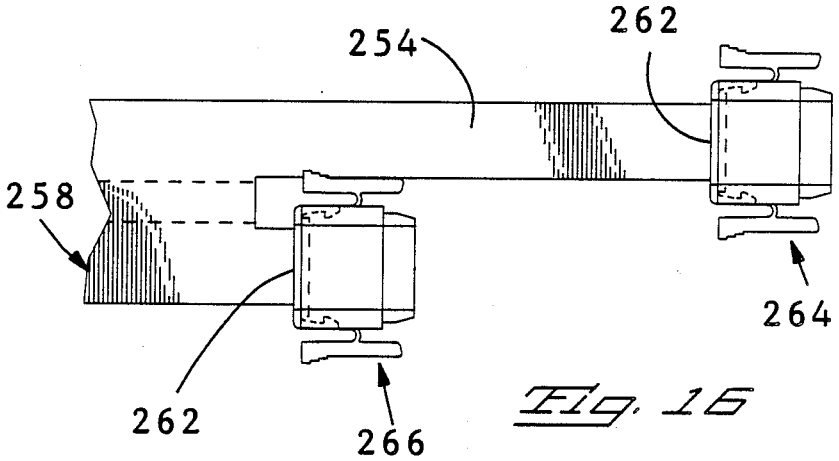

In FIGS. 15 and 16 are shown an alternate arrangement wherein terminals 250,252 are terminated to ends of respective cable portions 254,256 containing individual conductors of a dual conductor cable 258. Individual housing members 260 are shown for terminals 250,252, with individual cable strain relief members 262 shown to be placed and latched to rearward ends of housing members 260. The arrangement shown accommodates the desire to space the connectors 264,266 apart for the power and return paths established by the individual conductors of the cable.

Variations and modifications may be made to the embodiments disclosed herein, which are within the spirit of the invention and the scope of the claims.

What is claimed is:

1. A pair of terminals for terminating an end portion of flat power cable having at least one insulated conductor, comprising:

two like terminals each including a forward contact section and opposing upper and lower plate sections extending forwardly from a laterally spaced pair of bight straps and opposing each other spaced to receive a cable portion therebetween, said pair of bight sections defining a cable-receiving slot transversely across a rearward terminal end through which a said cable portion is insertable, said upper and lower plate sections including transverse termination regions thereacross containing respective arrays of shearing means adapted to penetrate the cable portion inserted therebetween upon said plate sections being pressed together to shear the insulation and the cable conductor therebetween, said plate sections being rotated together about said bight straps.

2. A pair of terminals as set forth in claim 1 wherein said two like terminals are arranged side-by-side to receive respective portions of said cable thereinto, whereafter said upper and lower plate sections are adapted to be simultaneously pressed respectively together terminating both cable portions,

3. A pair of terminals as set forth in claim 2 wherein said two like terminals are at least initially joined by a severable link, whereby handling thereof and cable termination is facilitated.

4. A pair of terminals as st forth in claim 3 wherein said cable is dual conductor and each of said two like terminals is associated with a respective one of the two conductors, whereby after cable termination said severable link is severed defining electrically separate conductor terminations.

5. A pair of terminals as set forth in claim 3 wherein said cable is single conductor and said severable link is retained unsevered.

6. A pair of terminals as set forth in claim 3 wherein outer ones of said pairs of bight sections include inwardly facing edges selectively spaced apart to create an interference fit with lateral outer edges of said flat cable upon insertion of said cable portions into respective said cable-receiving slots.

7. A pair of terminals as set forth in claim 1 wherein said arrays of shearing means comprise opposed arrays of shearing wave shapes alternating with relief recesses, each said shearing wave shape extending outwardly from a cable-proximate surface of a respective said plate section toward an associated said relief recess opposed therefrom having a concave shape adapted to receive said shearing wave shape thereinto upon termination, whereby upon termination said arrays of wave shapes shear respective strips of said at least one cable conductor and extrude said respective conductor strips into said associated relief recesses, exposing sheared conductor edges for electrical connection therewith.

8. A pair of terminals as set forth in claim 7 wherein said rearward ends of said upper and lower plate sections along said cable-receiving slots are spaced apart a distance equal to one cable thickness prior to termination, and said upper and lower plate sections coextend forwardly therefrom diverging a slight amount to receive a said cable portion therebetween against crests of said arrays of wave shapes, and such that upon termination said plate sections are rotatable about said bight sections with said rearward edges firmly clampingly engaging said cable portion therebetween and said wave shapes shear said cable conductor and extrude said strips.

9. A termination of a pair of terminals to an end of a flat power cable having- at least one insulated conductor, comprising:

a prepared end section of a flat power cable having an axial slot cut thereinto from an end edge substantially along the center of said cable and having a selected width, thereby defining a pair of spaced tab-shaped cable portions; and a pair of like terminals terminated onto respective said tab-shaped cable portions, each said terminal including a forward contact section and opposing upper and lower plate sections extending forwardly from a laterally spaced pair of bight straps and opposing each other defining a cable-receiving slot transversely across a rearward terminal end through which a said tab-shaped cable portion extends, said upper and lower plate sections including transverse termination regions thereacross containing respective arrays of shearing means penetrating at least through the cable insulation of the respective tab-shaped cable portion therebetween and establishing electrical connections with said cable conductor upon said plate sections having been pressed together.

10. A termination as set forth in claim 9 wherein said arrays of shearing means comprise opposed arrays of shearing wave shapes alternating with relief recesses, each said shearing wave shape extending outwardly from a cable-proximate surface of a respective said plate section toward an associated said relief recess opposed therefrom, and said arrays of wave shapes shearing respective strips of said at least one cable conductor and extruded said respective conductor strips into said associated relief recesses, and said terminals including means having engaged exposed sheared conductor edges of said conductor strips forming electrical connections therewith.

11. A termination as set forth in claim 9 wherein said two like terminals are arranged side-by-side and are at least initially joined by a severable link.

12. A termination as set forth in claim 11 wherein said cable is dual conductor and each of said two like terminals is associated with a respective one of the two conductors, whereby after cable termination said severable link is severed defining side-by-side electrically separate conductor terminations adapted to be housed in respective cavities of a common housing.

13. A termination as set forth in claim 11 wherein said cable includes a single conductor and said severable link is retained unsevered.

14. A termination as set forth in claim 9 wherein outer and inner ones of each said pair of bight straps include opposed facing edge surfaces spaced to have received said tab-shaped cable portions thereinto in close fit, whereby upon said upper and lower plate sections being pressed together against said tab-shaped cable portions therebetween by being rotated about said bight straps during termination, said facing edge surfaces have been forced tightly against outer and inner edge surfaces of respective said tab-shaped cable portions therebetween to define stops disallowing axial movement of said terminals along said cable.

15. A termination as set forth in claim 14 wherein said flat power cable is dual conductor and said axial slot severs narrow longitudinal portions of each conductor thereof and a medial strip of cable insulation therebetween, exposing sheared metal edge surfaces adjacent inner ones of said pairs of bight straps so that said edge surface of each said inner bight strap is deformed into said edge of a respective said conductor, and said edge of each said outer bight strap is pressed tightly into cable insulation along the respective outer cable edge.

16. A method of terminating flat power cable having cable insulation embedding at least one conductor, comprising the steps of:

selecting a pair of terminals each having a cable-receiving slot transversely across a rearward end thereof defined between facing edge surfaces of inner and outer bight straps spaced apart a known distance, said bight straps joining upper and lower plate sections of said terminal coextending forwardly from said rearward end and slightly diverging to receive a respective cable portion therebetween, and said upper and lower plate sections including arrays of shearing means transversely thereacross to at least penetrate the cable insulation and establish electrical connections with said at least one cable conductor;

cutting an axial slot inwardly from an end edge of said flat cable to be terminated and along the center thereof, said slot having a width selected to define tab-shaped cable portions having widths equal to said known distances between said outer and inner bight straps of said terminals;

inserting said tab-shaped cable portions into respective said cable-receiving slots of said terminals so that said tab-shaped cable portions fit snugly between said facing surfaces of said outer and inner bight straps; and pressing said upper and lower plate sections of said terminals together against respective said tab-shaped cable portions therebetween, by rotating said plate sections about said bight straps at said rearward ends, whereby said arrays of shearing means penetrate said cable insulation and establish electrical connections with said at least one cable conductor, and said facing surfaces of said outer and inner bight straps are deformed slightly toward each other and against adjacent edges of said tab-shaped cable portions and biting thereinto to define stops to disallow axial movement of said terminals along said tab-shaped cable portions.

17. A method of terminating flat cable as set forth in claim 16 wherein said cutting step exposes sheared metal edge surfaces adjacent inner ones of said pairs of bight straps so that said edge surface of each said inner bight strap is deformed into said sheared metal edge of said at last one conductor, and said edge surface of each said outer bight strap is pressed tightly into cable insulation along the respective outer cable edge.

18. A method of terminating flat power cable as set forth in claim 17 wherein said pair of terminals is at least initially joined together by a severable link and spaced a known distance apart whereby the distance between the inwardly facing surfaces of the outer ones of said bight straps approximately equals the width of said flat cable and the outwardly facing surfaces of the inner ones of said bight straps is also known, and said cutting step comprises cutting an axial slot having a width equal to the said known distance between the outwardly facing surfaces of the inner ones of said bight straps, whereby said outwardly facing inner bight strap surfaces are adjacent axial edges of said axial slot after insertion of said tab-shaped cable portions through respective said cable-receiving slots.

19. A method of terminating flat power cable as set forth in claim 17 wherein said flat power cable is dual conductor and said cutting step includes severing narrow longitudinal portions of each conductor thereof and a medial strip of cable insulation therebetween, and further includes the step of severing said severable link after termination to electrically separate said terminals and define respective terminations of said conductors.

20. A method of terminating flat power cable as set forth in claim 16 further including the additional step of placing said terminals in housing means.

* * * * *

UNITED STATES PATENT OFFICE

CERTIFICATE OF CORRECTION

Patent No. 4,915,650 Dated April 10, 1990

Inventor(s) John K. Daly et al.

It is certified that error appears in the above-identified patent and that said Letters Patent is hereby corrected as shown below:

In the Claims:

Column 9, Claim 4, Line 1 - The word "st" should be "set".

Column 10, Claim 15, Line 44 - Insert "sheared metal" after the first occurrence of the word "said".

Column 10, Claim 15, Line 45 - Insert the word "surface" before the word "of".

Signed and Sealed this

Thirteenth Day of August, 1991

*Attest:*

HARRY F. MANBECK, JR.

*Attesting Officer*

*Commissioner of Patents and Trademarks*